US005221092A

United States Patent [19]

Simons, Jr. et al.

[11] Patent Number: 5,221,092

[45] Date of Patent: Jun. 22, 1993

[54] PROJECTILE-TARGET GAME APPARATUS

[76] Inventors: William F. Simons, Jr.; Margot T. Simons, both of 306 Jays Avenue, Williamstown, N.J. 08094

[21] Appl. No.: 904,466

[22] Filed: Jun. 25, 1992

[51] Int. Cl.[5] ..... A63B 67/00; A41B 1/00; F41J 1/00

[52] U.S. Cl. ..... 273/346; 2/1; 124/1; 273/407; 273/409; 273/DIG. 30

[58] Field of Search ..... 273/345, 346, 347, 405, 273/407, 409, 410, DIG. 30; 2/1; 124/1

[56] References Cited

U.S. PATENT DOCUMENTS 3,032,345 5/1962 Lemelson ..... 273/346
3,857,566 12/1974 Lemelson et al. ..... 273/346
4,054,120 10/1977 Foley ..... 273/346 X
4,354,282 10/1982 Langdon ..... 273/DIG. 30 X
4,971,334 11/1990 Stewart ..... 273/346
4,986,548 1/1991 Conner ..... 273/346
5,082,291 1/1992 Appel et al. ..... 273/346
5,100,152 3/1992 Butler, III ..... 273/346
5,139,273 8/1992 Rudell et al. ..... 273/346

*Primary Examiner*—William H. Grieb
*Attorney, Agent, or Firm*—Abdallah & Muckelroy

[57] ABSTRACT

A ball game apparatus including a ball-projecting gun, at least one ball, and a coat-type garment having a plurality of ball adhering portions to which the ball adheres to when projected by the gun. The coat type garment includes scoring indicia for each ball adhering portion which correspond in value to the extent of injury that would be caused by a projectile striking a corresponding portion of the body. Thus, a ball that adheres to a ball adhering portion located close to the heart of the player is scored a higher value than a ball that adheres to a ball adhering portion located on the arm of the player.

12 Claims, 2 Drawing Sheets

PROJECTILE-TARGET GAME APPARATUS

BACKGROUND OF THE INVENTION

The present invention generally relates to games and game apparatus. More specifically, this invention relates to a projectile-target game apparatus that includes a ball that is projected by a gun and an upper body garment to which the ball adheres to when projected toward a player wearing the garment.

Various projectile-target games and apparatus are known in the prior art wherein a garment-adhering ball is thrown toward a player wearing a ball-adhering upper body garment. In U.S. Pat. No. 5,082,291 to Appel et al. a projectile-target game apparatus is disclosed comprising a releasably bonding projectile and a cap having a projectile-adhering surface. U.S. Pat. No. 4,971,334 to Stewart discloses a projectile-target game apparatus that includes a vest-type garment having projectile adhering front and rear surfaces and a projectile configured to travel in an abnormal trajectory when thrown. U.S. Pat. No. 4,986,548 to Conner shows a projectile-target ball game apparatus including a ball disposed in a garment-adhering jacket and a ball-adhering upper body garment. In U.S. Pat. No. 5,100,152 to Butler a projectile-target ball game apparatus is disclosed that includes a projectile formed to produce eddies in the air when the projectile is thrown and a projectile-adhering garment to be worn by a player.

Certain limitations in the prior art projectile-target game apparatus are overcome by the ball game apparatus of the present invention. Firstly, the prior art disclosures are directed to apparatus for use by two or more players. The various upper body garments are worn by respective players and the projectile is tossed between players. These apparatus thus cannot be used for play by one person. Secondly, in the prior art projectile-target game apparatus the projectile is tossed by hand between players. Skillful play is therefore dominated by the motor skills of the participants. Thirdly, the projectile-target game apparatus in the prior art having scoring indicia disposed on the upper body garment have such scoring indicia randomly disposed thereon absent any strategical or "real-world" relationship between the score value and the position of the associated surface relative to the body of the player.

SUMMARY OF THE INVENTION

The present invention is a projectile-target game apparatus that generally includes an air-powered ball-projecting gun, a plurality of garment-adhering balls selectively projectable by the gun, and a sleeved coat-type garment having a plurality of ball-adhering portions on its outside surface. Each ball-adhering portion of the garment has respective scoring indicia that correspond in value to strategic positions of the player's body. The coat-type garment further includes a bullseye target formed from ball-adhering material disposed on an inside surface of the garment and hanger loops disposed from the inside surface for hanging the garment on a wall or the like for play by a single person.

An object of the present invention is to provide a projectile-target game apparatus to simulate war games.

Another object of this invention is to provide a projectile-target game apparatus that can be used for play by either one or a plurality of persons.

It is also an object of the present invention to provide a game apparatus that limits the requirement of advanced motor skills for skillful play of the game.

A still further object of this invention is to provide a projectile-target game apparatus having score valuations which simulate the extent of damage from a "hit" to varying portions of a person's body.

These and other objects and advantages of the present invention will be apparent to those skilled in the art from the following description of a preferred embodiment, claims and appended drawings.

DESCRIPTION OF A PREFERRED EMBODIMENT

Figure 1:
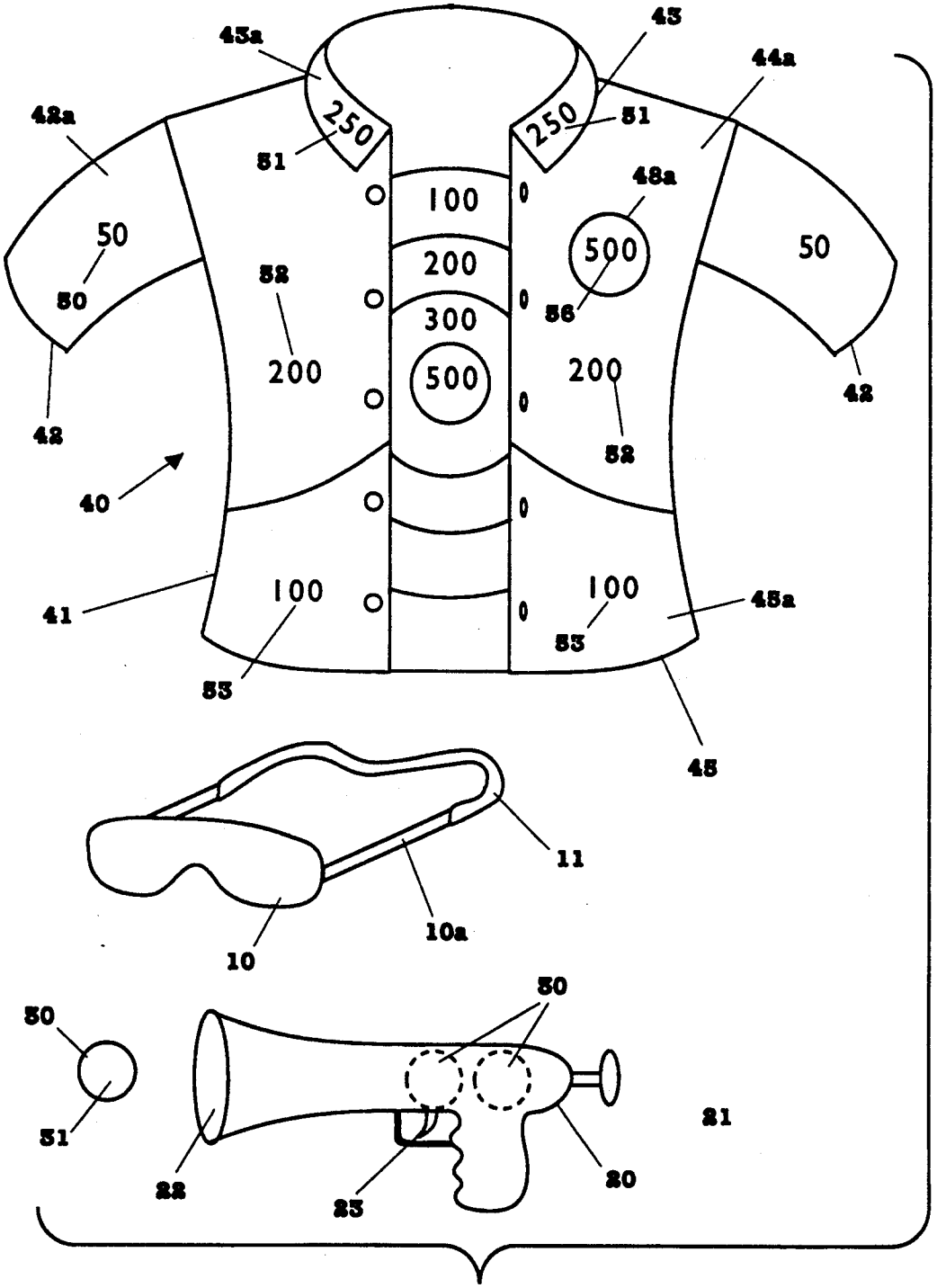
FIG. 1 is a front perspective view of the projectile-target game apparatus of the present invention.

FIG. 1 illustrates in a front perspective view the novel projectile-target game apparatus 1 of the present invention. Game apparatus 1 generally includes a pair of protective eyewear 10, a ball-projecting gun 20, a plurality of garment-adhering balls 30 projectable by the gun 20 and a ball-adhering upper body garment 40. As generally understood in the art garment 40 is worn by a first player and a second player projects a ball 30 toward the garment 40 in a competitive game that simulates war. As should be further understood second player also wears a similar garment 40 and first player utilizes a like gun 20 to project a ball 30 toward the second player. The game apparatus 1 of the present invention also permits individual play as hereinafter described in greater detail.

Protective eyewear 10 may be constructed as any of a variety of goggles, shades or safety glasses known in the art for protecting the eyeball and surrounding eye socket. Eyewear 10 preferably includes an elastic strap 11 extending from respective arms **10*a* thereof to facilitate maintenance of the eyewear 10** on a player's head.

Gun 20 is preferably an air-powered device that includes a pump 21 to compress air within the barrel 22 of gun 20, the compressed air being released to project a ball 30 outwardly from barrel 22 by operation of the gun trigger 23.

Garment-adhering ball 30 preferably comprises a sphere having a surface 31 formed from releasable bonding material that cooperably adheres to garment 40 when the ball 30 is projected from gun 20. In the preferred embodiment of the present invention the surface 31 of ball 30 is formed from a hook portion of hook and loop tape material, the garment 40 having loop portions of hook and loop tape material disposed on the surface thereof for cooperable engagement of a ball 30 as hereinafter described in greater detail.

Figure 2:
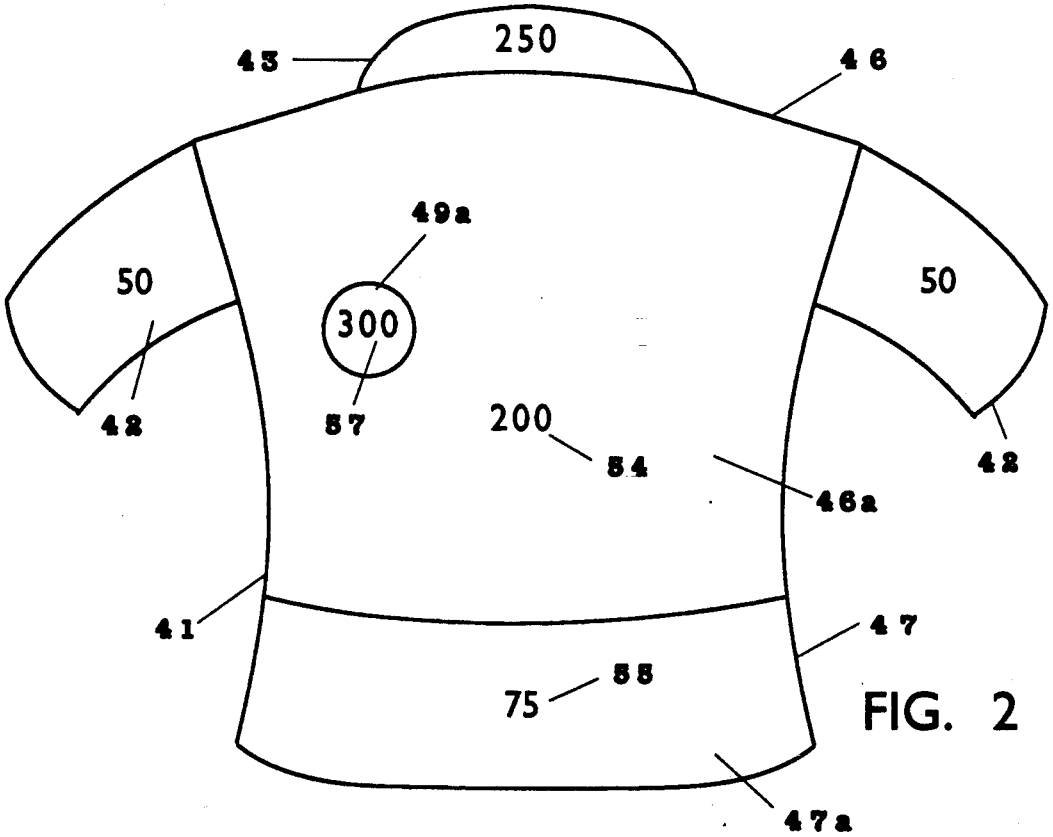
FIG. 2 is a rear elevational view of the upper body garment of the game apparatus.

Ball-adhering upper body garment 40 is preferably a sleeved coat-type garment including a main body portion 41 and respective sleeves 42 attached to respective sides of main body portion 41. The outer surface of garment 40 includes a plurality of ball-adhering portions, each portion preferably being formed from loop portions of hook and loop tape material as heretofore noted. First ball-adhering portions **42*a* are disposed on the outer surface of the respective sleeves 42 of garment 40; a second ball-adhering portion 43a is disposed on the outer surface of the collar 43 of the main body portion 41 of garment 40; a third ball-adhering portion 44a is disposed on the outer surface of an upper forward portion 44 of the main body portion 41 of garment 40; a fourth ball-adhering portion 45a is disposed on the outer surface of a lower forward portion 45 of the main body portion 41. As can be seen in FIG. 2 a fifth ball-adhering portion 46a is disposed on the outer surface of an upper rearward portion 46 of the main body portion 41 of garment 40 and a sixth ball-adhering portion 47a is disposed on an outer surface of a lower rearward portion 47 of the main body portion 41. Main body portion 41 further includes a seventh ball-adhering portion 48a disposed on an outer surface of garment 40 within a central portion of the third ball-adhering portion 44a (FIG. 1) and an eighth ball-adhering portion 49a disposed on an outer surface of garment 40 within the fifth ball-adhering portion 46a (FIG. 2**).

The various ball-adhering portions 42a–49a of garment 40 are disposed to correspond to various parts of a player's body when the garment 40 is worn. Thus, the adhesion of a ball 30 to respective ball-adhering portions 42a–49 simulates a strike to varying portions of the player's body. For examples, adhesion of a ball 30 to the third ball-adhering portion 44a corresponds to a simulated strike to the chest area of a player; adhesion of a ball 30 to a first ball-adhering portion 42a corresponds to a simulated shoulder or arm strike. In the preferred embodiment seventh ball-adhering portion 48a is disposed approximate to the heart of the player. Thus adhesion of a ball 30 to the seventh ball-adhering portion 48a corresponds to a simulated fatal strike to a player.

Respective scoring indicia 50–57 are disposed on the various ball-adhering portions 42a–49a of garment 40. In view of the correspondence between the disposition of the ball-adhering portions 42a–49a on garment 40 and a simulated strike to a player's body, the respective scoring indicia correspond in value to the extent of injury that would be caused by the corresponding simulated strike. Thus the seventh scoring indicia 56 disposed on the seventh ball-adhering portion 48a, simulating a strike to a player's heart, has the highest value. In the preferred embodiment the first scoring indicia has a value of 50, the second scoring indicia 51 has a value of 250, the third scoring indicia 52 has a value of 200, the fourth scoring indicia 53 has a value of 100, the fifth scoring indicia 54 has a value of 200, the sixth scoring indicia 57 has a value of 200, the sixth scoring indicia 55 has a value of 75, the seventh scoring indicia 56 has a value of 500 and the eighth scoring indicia 57 has a value of 300. Thus, it should be understood that a player can achieve a higher score by striking ball-adhering portions that correspond to an expected greater extent of injury that would be caused by similar strike to a player's body. This simulation of "real world" injury adds to the fun and excitement of play using the game apparatus 1 of the present invention. The various ball-adhering portions 42a–49a may also be formed in different colors and/or surface patterns.

Figure 3:
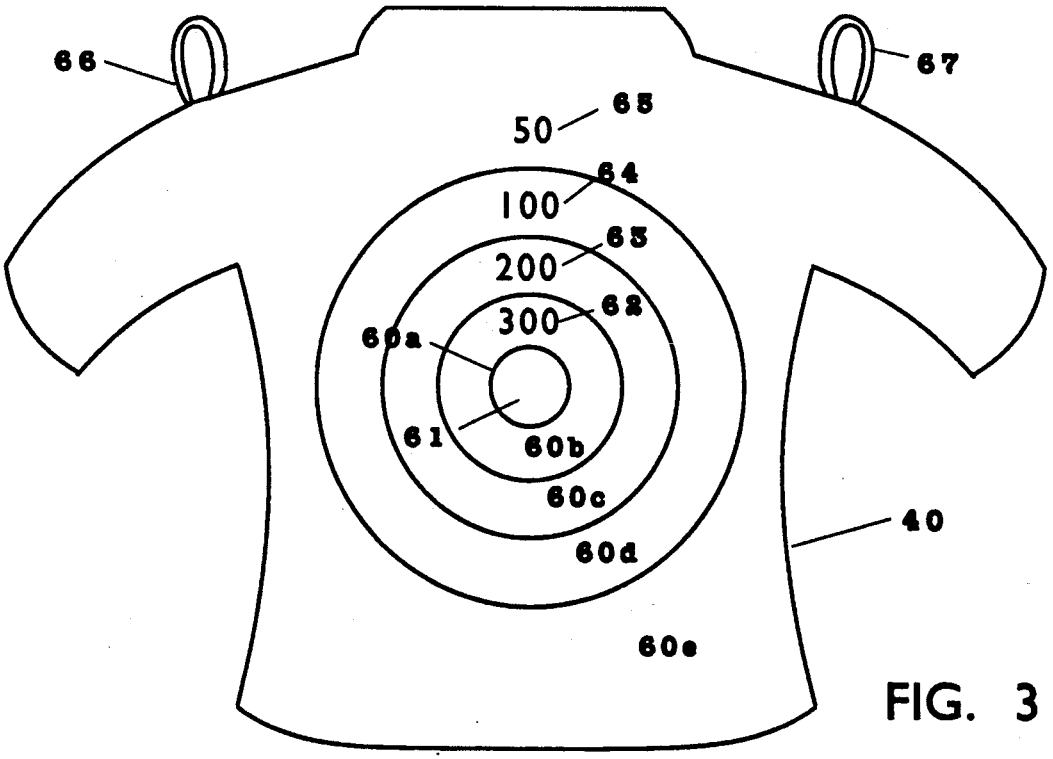
FIG. 3 is a front elevational view of the upper body garment turned inside out for hanging display of the bullseye target for play by a single person.

A further improvement in projectile-target game apparatus is provided by the present invention by its provision of means for play by an individual person. As heretofore described when garment 40 is worn by respective players, players provide a moving target for opposing players. The garment 40 of the present invention is also convertible to a stationary target for individual play. As illustrated in FIG. 3 garment 40 can be turned inside out to display a ball-adhering bullseye target 60 on the inner surface of the rearward portion of garment 40. Bullseye target 60 is formed from ball-adhering material, preferably loop portions of hook and loop tape material. Scoring indicia 61–65 of increasing value from center to periphery are disposed on the concentric rings 60a, 60b, 60c, 60d and 60e of bullseye target 60 as known in the art. Loop hangers 66, 67 are fixedly attached to the inner surface of garment 40 at respective shoulders thereof to permit garment 40 to be attached to a wall, door or the like.

Various changes, modifications and additions may be made to the preferred embodiment of the present invention without departing from the spirit and scope of the present disclosure. Such changes, modifications and additions within a fair reading of the following claims are intended as part of the present invention.

Therefore, in view of the foregoing we claim:

1. A projectile-target game apparatus comprising a ball-projecting gun;

at least one ball projectable by said gun, said ball having a surface formed from a releasable bonding material; and an upper body garment having an outer surface and an inner surface, said garment including a plurality of ball-adhering portions disposed in displaced relationship on the outer surface of said garment, each said ball-adhering portion having a respective scoring indicia disposed thereon, said garment further including a ball-adhering bullseye target disposed on the inner surface of said garment.

2. A projectile-target game apparatus as in claim 1 wherein said ball-projecting gun is air-powered.

3. A projectile-target game apparatus as in claim 1 wherein said releasable bonding material is a hook portion of hook and loop tape material.

4. A projectile-target game apparatus as in claim 3 wherein said ball adhering portions of said garment comprises respective loop portions of hook and loop tape material.

5. A projectile-target game apparatus as in claim 4 wherein said upper body garment comprises a sleeved coat-type garment.

6. A projectile-target game apparatus as in claim 5 wherein a first ball adhering portion is disposed on respective sleeves of the garment, a second ball adhering portion is disposed on a collar of the garment, a third ball adhering portion is disposed on an upper forward portion of the garment, a fourth ball adhering portion is disposed on a lower forward portion of the garment, a fifth ball adhering portion is disposed on an upper rearward portion of the garment, a sixth ball adhering portion is disposed on a lower rearward portion of the garment, a seventh ball adhering portion is disposed within said third adhering portion and an eighth ball adhering portion is disposed within said fifth adhering portion.

7. A projectile-target game apparatus as in claim 1 wherein the respective scoring indicia correspond in value to the extent of injury that would be caused by a projectile striking at corresponding positions of a player's body.

8. A projectile-target game apparatus as in claim 7 wherein a first ball adhering portion is disposed on respective sleeves of the garment and said first ball adhering portion includes a first scoring indicia having a value of 50, a second ball adhering portion is disposed on a collar of the garment and said second ball adhering portion includes second scoring indicia having a value of 250, a third ball adhering portion is disposed on an upper forward portion of the garment and said third ball adhering portion includes a third scoring indicia having a value of 200, a fourth ball adhering portion is disposed on a lower portion of the garment and said fourth ball adhering portion includes a fourth scoring indicia having a value of 100, a fifth ball adhering portion is disposed on upper rearward portion of the garment and said fifth ball adhering portion includes a fifth scoring indicia having a value of 200, a sixth ball adhering portion is disposed on a lower rearward portion of the garment and said sixth ball adhering portion includes a sixth scoring indicia having a value of 75, a seventh ball adhering portion is disposed within said third ball adhering portion and said seventh ball adhering portion includes a seventh scoring indicia having a value of 500, and an eighth ball adhering portion is disposed within said fifth ball adhering portion and said eighth ball adhering portion includes an eighth scoring indicia having a value of 300.

9. A projectile-target game apparatus comprising an air-powered ball-projecting gun;

at least one ball projectable by said gun, said ball having a surface formed from a hook portion of hook and loop tape material; and a sleeved coat-type garment having an outside surface and an inside surface, said garment including a first ball adhering portion disposed on the outside surface of respective sleeves of the garment, said first ball adhering portion including a first scoring indicia having a value of 50, a second ball adhering portion disposed on the outside surface of a collar of the garment, said second ball adhering portion including a second scoring indicia having a value of 250, a third ball adhering portion disposed on an upper forward portion of the outside surface of the garment, said third ball adhering portion including a third scoring indicia having a value of 200, a fourth ball adhering portion disposed on a lower forward portion of the outside surface of the garment, said fourth ball adhering portion including a fourth scoring indicia having a value of 100, a fifth ball adhering portion disposed on an upper rearward portion of the outside surface of the garment, said fifth ball adhering portion including a fifth scoring indicia having a value of 200, a sixth ball adhering portion disposed on a lower rearward portion of the outside surface of the garment, said sixth ball adhering portion including a sixth scoring indicia having a value of 75, a seventh ball adhering portion disposed on the outside surface of the garment within the third ball adhering portion, said seventh ball adhering portion including a seventh scoring indicia having a value of 500, and an eighth ball adhering portion disposed on the outside surface of the garment within the fifth ball adhering portion said eighth ball adhering portion including an eighth scoring indicia having a value of 300, said respective ball adhering portions comprising respective loop portions of hook and loop tape material, said garment further including a ball adhering bullseye target disposed on the inside surface of the garment, said target comprising a loop portion of hook and loop tape material.

10. A projectile-target game apparatus as in claim 9 further including a pair of protective eyewear.

11. A projectile-target game apparatus as in claim 9 further including garment support means for hanging said garment in an upright position.

12. A projectile-target game apparatus as in claim 11 wherein said garment support means comprises a pair of loop hangers fixedly attached to the inside surface of said garment at respective shoulders thereof.

* * * * *